US006494394B1

(12) United States Patent
Balvanz et al.

(10) Patent No.: US 6,494,394 B1
(45) Date of Patent: Dec. 17, 2002

(54) INTERMEDIARY FACE PLATE FOR SADDLE-BACK HAMMER TIP

(75) Inventors: Loran R. Balvanz, New Providence, IA (US); Paul R. Gray, New Providence, IA (US)

(73) Assignee: U.S. Manufacturing, Inc., New Providence, IA (US)

( * ) Notice: Subject to any disclaimer, the term of this patent is extended or adjusted under 35 U.S.C. 154(b) by 0 days.

(21) Appl. No.: 09/834,788

(22) Filed: Apr. 13, 2001

(51) Int. Cl.[7] ..... B02C 13/02

(52) U.S. Cl. ..... 241/197; 241/191; 241/195; 241/300

(58) Field of Search ..... 241/191, 195, 241/197, 300, 189.1

(56) References Cited

U.S. PATENT DOCUMENTS 3,680,797 A * 8/1972 Covey ..... 241/191
5,285,974 A * 2/1994 Cesarini ..... 241/194
5,320,292 A * 6/1994 Smith ..... 144/229
5,967,436 A * 10/1999 Balvanz ..... 241/195
6,079,649 A * 6/2000 Balvanz et al. ..... 241/189.1
6,131,838 A * 10/2000 Balvanz et al. ..... 241/195
6,142,400 A * 11/2000 Balvanz et al. ..... 241/191
6,311,910 B1 * 11/2001 Balvanz et al. ..... 241/191

OTHER PUBLICATIONS

Drawing of Rotor, 28 Bit, Asembly HC–5400 Date: Dec. 31, 1998, Peterson Pacific Corp.

* cited by examiner

*Primary Examiner*—William Hong
(74) *Attorney, Agent, or Firm*—Daniel A. Rosenberg; Kent A. Herink; Davis Brown Law Firm

(57) ABSTRACT

A face plate is provided for releasable attachment between a hammer and a hammer tip of a size reducing machine. The face plate provides a buffer between the hammer and the hammer tip. The hammer has a body with a forward facing hammer face that aligns with the back of the face plate. The front of the face plate aligns with the back of the hammer tip. The hammer, hammer tip, and face plate contain aligned bolt holes for receipt of a securement bolt that releasably secures the hammer, face plate, and hammer tip. The face plate includes a center section raised above opposing ledges designed for mated alignment with a recessed center section of the back of the hammer tip.

6 Claims, 3 Drawing Sheets

INTERMEDIARY FACE PLATE FOR SADDLE-BACK HAMMER TIP

RELATED APPLICATIONS

This application hereby incorporates by reference U.S. patent application Ser. No. 09/326,209 filed on Jun. 4, 1999, now U.S. Pat. No. 6,131,838 entitled SADDLE-BACK HAMMER TIP.

BACKGROUND OF THE INVENTION

The present invention relates to a face plate for releasable attachment between a hammer and a hammer tip. In particular, the face plate attaches between the hammer tip and the hammer a size reducing machine.

Size reducing machines, like tub grinders, rotary hammer mills, vertical and horizontal feed machines, and the like, are used to process waste material. The machines consist of a large tub or drum containing a motor driven rotor that spins on a central shaft. A plurality of hammers attach to the rotor, and extend radially outward into the debris path. Hammer tips, or inserts, in turn, attach to the exposed face of the hammers. The edges of the hammer tips contact the debris. This impact in major part converts the material in the machine to debris sized to pass through a screen and out of the machine. The hammer tips are replaceable in view of the wear they experience during operation.

The conventional method for attaching a hammer tip to a hammer comprises inserting one or two bolts through a bolt hole in the hammer tip and hammer then securing the threaded end of the bolt with a threaded nut. Generally, this comprises the sole means of attachment. However, U.S. patent application Ser. No. 09/326,209 filed on Jun. 4, 1999 entitled SADDLE-BACK HAMMER TIP discloses a novel method for further securing the hammer tips to the hammers. Namely, the back of the hammer tip includes two opposing shoulder sections with a recessed section therebetween. The shoulder sections and the recess formed there between create a saddle-back for releasable integration with the hammer face.

During operation of the size-reducing machine, however, the hammer tips come into frequent and violent contact with the product under seeing size reduction. In addition to causing the hammer tips to wear, extreme hits to the hammer tips and damage the tips and in some cases damage the hammers. Additionally, the hammer tips can break and dislodge from the hammers. This leaves the hammers exposed to impact. In some cases the failure to timely replace the hammer tips can result in excessive wear, even to the point were the hammer tip wears all the way through again exposing the hammer to impact. It is not unusual to have to replace the hammers because of damage, dislodging, or excessive wear of the hammer tips. Replacing a hammer results in excessive downtime, increased costs in terms of parts and labor, and other disadvantages that increase the cost of operating the size-reducing machine.

Accordingly, a need exists in the art for a way to reduce damage to the hammers, and to more easily repair damaged hammers.

SUMMARY OF THE INVENTION

An object of the present invention comprises providing a face plate that will provide protection to the hammer in the case of import to the hammer tip.

These and other objects of the present invention will become apparent to those skilled in the art upon reference to the following specification, drawings, and claims.

The present invention intends to overcome the difficulties encountered heretofore. To that end, a face plate is provided for releasable attachment between a hammer and a hammer tip of a size-reducing machine. The face plate provides a buffer between the hammer and the hammer tip. The hammer has a body with a forward facing hammer face that aligns with the back of the face plate. The front of the face plate aligns with the back of the hammer tip. The hammer, hammer tip, and face plate contain aligned bolt holes for receipt of a securement bolt that releasably secures the hammer, face plate, and hammer tip.

DETAILED DESCRIPTION OF THE INVENTION

Figure 1B:
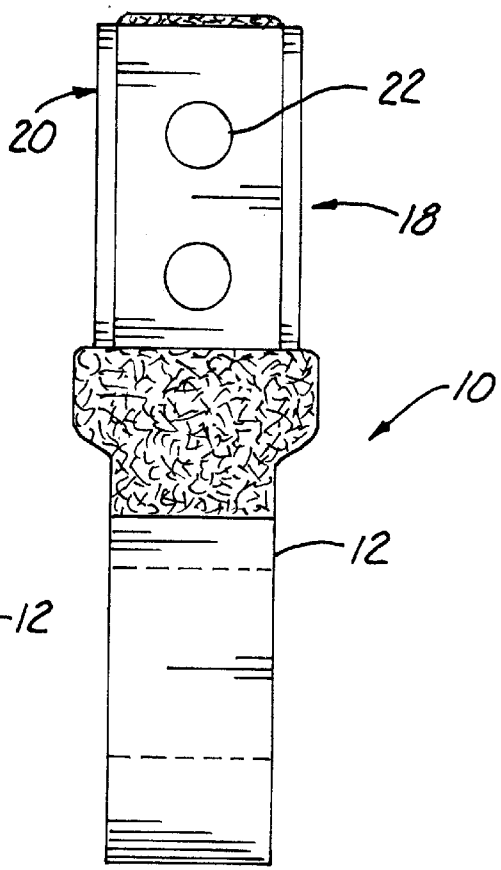
FIG. 1*b* is an end view of the hammer and face plate of FIG. 1*a*.
Figure 1A:
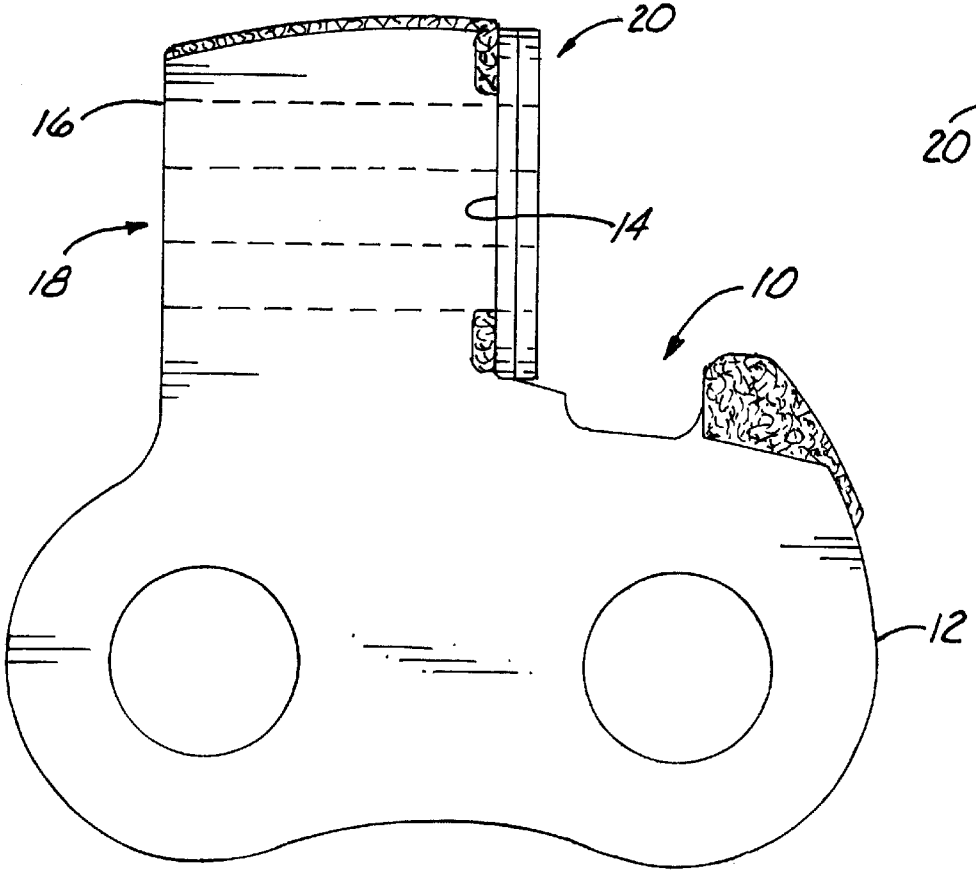
FIG. 1*a* is a side view of a hammer and a face plate.

In the Figures, FIGS. 1*a–b* show a hammer 10 with a lower body portion 12 and an upper body portion 18. The lower body portion 12 is designed for securement to a rotor (not shown) of a size reducing machine (not shown). The upper body portion 18 of the hammer 10 extends into the debris path during operation of the size reducing machine. The upper body portion 18 of the hammer 10 includes a forward facing front face 14 and bolt holes 16.

Figure 2B:
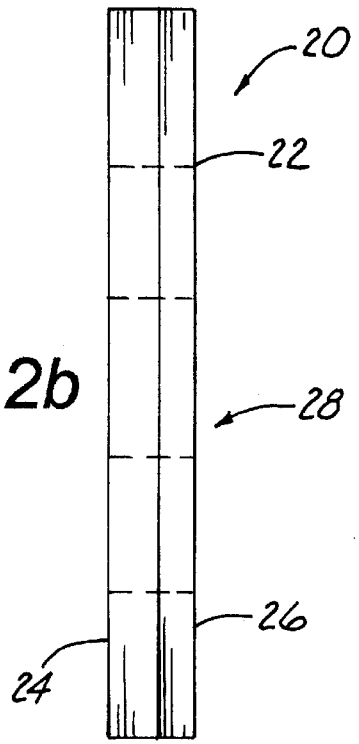
FIG. 2*b* is a side view of the face plate of FIG. 1.
Figure 2A:
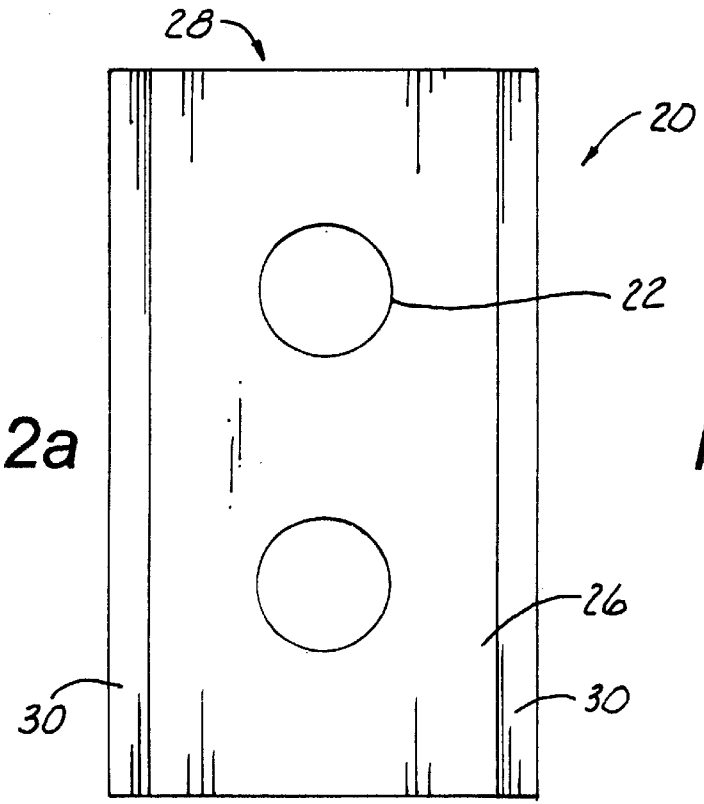
FIG. 2*a* is a front view of the face plate of FIG. 1.
Figure 2C:
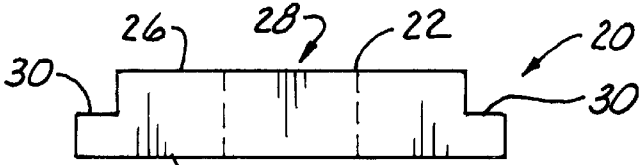
FIG. 2*c* is an end view of the face plate of FIG. 1.
Figure 3C:
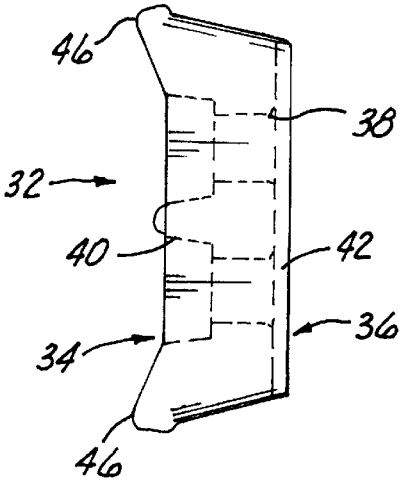
FIG. 3*c* is a side view of the hammer tip of FIG. 3*a*.
Figure 3B:
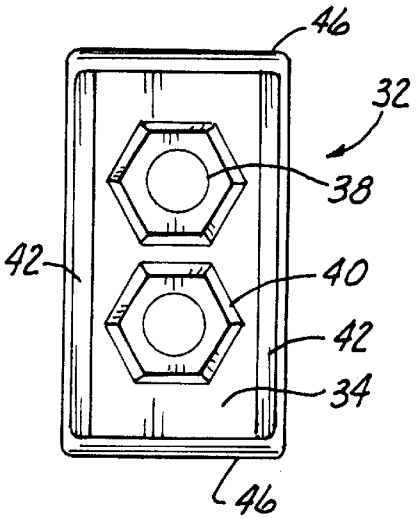
FIG. 3*b* is a top view of the hammer tip of FIG. 3*a*.
Figure 3A:
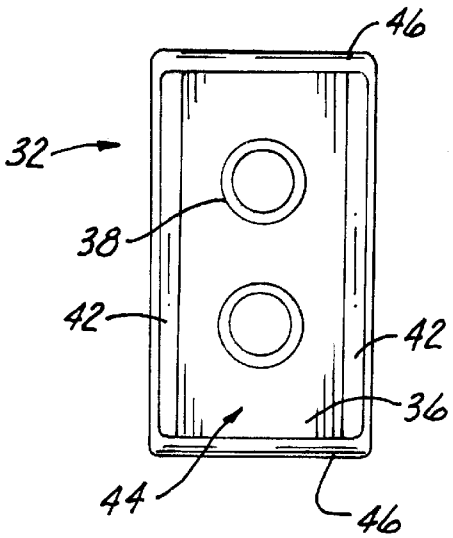
FIG. 3*a* is a bottom view of a hammer tip.
Figure 3D:
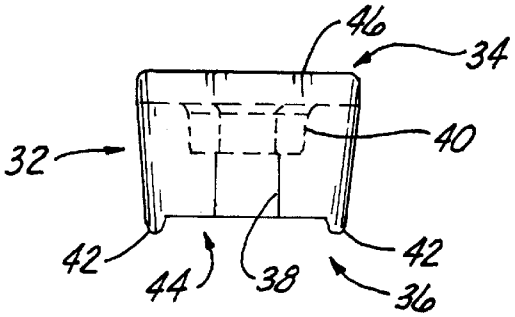
FIG. 3*d* is an end view of the hammer tip of FIG. 3*a*.

FIGS. 1*a–b* also shows a face plate 20 that is sized to fit over the front face 14 of the hammer 10. The face plate 20 includes bolt holes 22 that align with the bolt holes 16 of the hammer 10. Shown best in FIGS. 2*a–c*, the face plate 20 also includes a back 24, a front 28, and a raised center section 26. The back 24 faces the forward facing front face 14 of the hammer 10. The raised center section 26 if formed by cutting away portions at either edge of the face plate 20. This essentially leaves a ledge 30 on both side of the face plate 20.

FIGS. 3*a–d* show a hammer tip 32 that includes a front 34, a back 36, opposing hammer tips 46, and bolt holes 38. The front 34 of the hammer tip 32 includes a hexagonal recessed portion 40 for receipt of a similarly shaped bolt head (not shown). This minimizes the exposure of the bolt head to debris, thereby preventing shearing of the bolt head. The hammer tip 32 also includes working edges 46 designed to impact the debris during operation. The hammer tip 32 includes two working edges, which allows for rotating the hammer tip 32 after one of the working edge 44 becomes worn. This essentially doubles the life of the hammer tip 32.

The back 36 of the hammer tip 32 includes a two opposing shoulder sections 42 and a recessed section 44 therebetween. The combination of the shoulder sections 42 and the recessed section 44 comprises a saddle-back, described in greater detail in U.S. patent application Ser. No. 09/326,209 filed on Jun. 4, 1999 entitled SADDLE-BACK HAMMER TIP. The back 36 of the hammer tip 32 with the shoulder sections 42 and the recessed portion 44 there between, is designed for mating alignment with the raised center section 26 of the face plate 20. That is the raised center section 26 fits within the recessed portion 44 of the hammer tip 32, and the shoulder sections 42 of the hammer tip 32 align with the ledges 30 of the face plate 20.

In this manner, the face plate 20 provides a buffer between the hammer 10 and the hammer tip 32. In the case of an impact that damages the hammer tip 32, excessive wear to a hammer tip 32, or a dislodged hammer tip 32 the face plate 20 should absorb the impact thereby protecting the hammer 10. Reducing damage to the hammer 10 will prevent the downtime and associated costs incurred with replacing or repairing the hammer 10. The face plate 20 is easily replaced when the hammer tip 32 is replaced.

In addition to securement provided by the bolts that secure the hammer 10 and the hammer tip 32, the face plate 20 is tack welded to the hammer 10. In the preferred embodiment of the present invention, the face plate 20 is designed for use with rotors that utilize pins or rods to secure the hammers 10, as opposed to drum type rotors. However, the invention is not necessarily so limited.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

What is claimed is:

1. A face plate for releasable attachment between a hammer and a hammer tip of a size reducing machine, comprising:

a hammer having a body with a forward facing hammer face, and at least one bolt hole passing through said hammer face of said hammer body;

a hammer tip with a front and a back, having at least one bolt hole passing there between, said bolt hole aligned with said bolt hole of said hammer;

a face plate with a back that faces said hammer face and a front with a raised center section that faces said back of said hammer tip, said face plate sized to fit between said hammer face and said back of said hammer tip, with at least one bolt hole aligned with said bolt holes of said hammer and said hammer tip, such that said face plate functions as a buffer between said hammer and said back of said hammer tip;

wherein said hammer tip has two opposing shoulder sections with a recessed section therebetween forming a saddle-back for mated alignment with said front of said face plate; and at least one bolt for insertion in to said bolt holes of said hammer, hammer tip, and face plate, thereby releasably securing said hammer, face plate, and said hammer tip.

2. The invention in accordance with claim 1 wherein said hammer, hammer tip, and face plate have two bolt holes.

3. The invention in accordance with claim 2 further comprising two bolts for releasably securing said hammer, face plate, and said hammer tip through said bolt holes.

4. The invention in accordance with claim 1 wherein said front of said hammer tip has a distally located working edge for impacting debris.

5. The invention in accordance with claim 4 wherein said front of said hammer tip has two oppositely located distally and working edges for impacting debris.

6. A face plate for releasable attachment between a hammer and a hammer tip of a size reducing machine, comprising:

a hammer having a body that secures to a rotor of a size reducing machine, with said hammer body having a forward facing hammer face, and two bolt holes passing through said hammer face of said hammer body;

a hammer tip with a front having two oppositely and distally located working edges for impacting debris, and having a back, and said hammer tip having two opposing shoulder sections with a recessed section therebetween forming a addle-back for mated alignment with said front of said face plate, and with said hammer tip having two bolt holes passing between said front and said back of said hammer tip with said bolt holes aligned with said bolt holes of said hammer;

a face plate sized to fit between said hammer face and said back of said hammer tip, having a front with a raised center section that faces said back of said hammer tip, and having a back that faces said hammer face, and with two bolt holes aligned with said bolt holes of said hammer and said hammer tip, such that said face plate functions as a buffer between said hammer face and said back of said hammer tip; and two bolts for releasably securing said hammer, said face plate, and said hammer tip through said bolt holes.

* * * * *